United States Patent [19]

Lionetti et al.

[11] 4,069,141

[45] Jan. 17, 1978

[54] PROCESS FOR RECOVERING FUEL OIL FROM TOPPED CRUDE

[75] Inventors: Thomas A. Lionetti, Port Arthur; Kenneth D. Miller, Spring; Levi C. Parker, Port Arthur, all of Tex.

[73] Assignee: Texaco Inc., New York, N.Y.

[21] Appl. No.: 754,787

[22] Filed: Dec. 27, 1976

[51] Int. Cl.[2] ..... C10G 21/16

[52] U.S. Cl. ..... 208/309; 208/251 R

[58] Field of Search ..... 208/251 R, 309

[56] References Cited

U.S. PATENT DOCUMENTS

| | | | |
|---|---|---|---|
| 3,255,104 | 7/1966 | Moyer | 208/309 |
| 3,278,415 | 10/1966 | Doberenz et al. | 208/309 |
| 3,303,122 | 2/1967 | Doelman | 208/309 |
| 3,364,138 | 1/1968 | Campagne et al. | 208/309 |

*Primary Examiner*—Herbert Levine

*Attorney, Agent, or Firm*—Carl G. Ries; Thomas H. Whaley; Douglas H. May, Jr.

[57] ABSTRACT

A topped crude oil is admixed with a hydrocarbon solvent and centrifuged in the presence of a brine carrier to produce a hydrocarbon solvent-fuel oil mixture and a brine-asphalt-fuel oil mixture, the latter mixture being recovered and admixed with a ketone solvent which effects emulsion breaking and extracts residual fuel oil, a ketone solvent rich phase being subsequently recovered and subjected to fractionation to separate the fuel oil from the ketone solvent, the latter being recycled for further usage.

18 Claims, 1 Drawing Figure

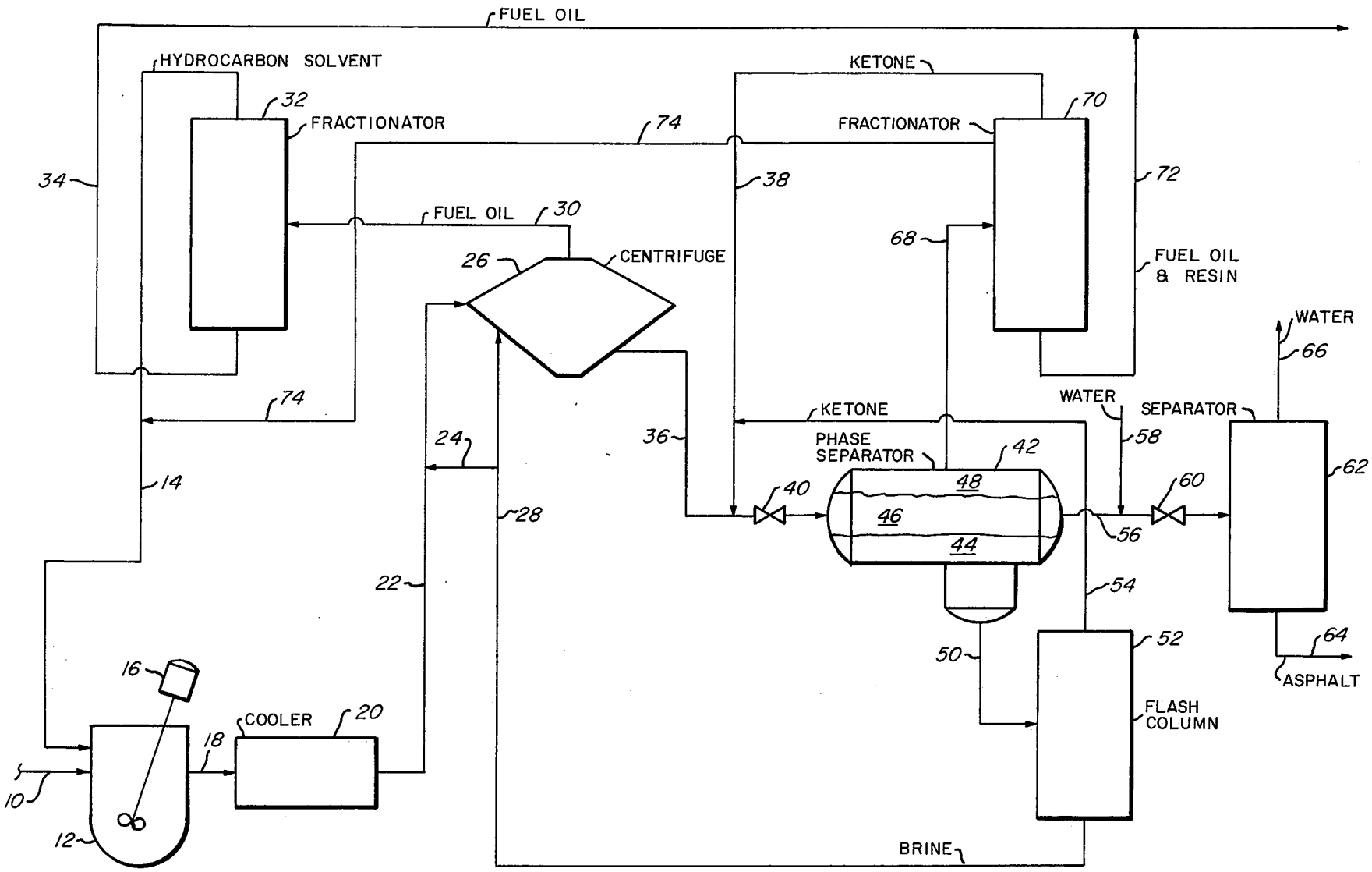
FUEL OIL
HYDROCARBON SOLVENT
FRACTIONATOR
32
34
FUEL OIL
30
74
CENTRIFUGE
26
28
24
22
20
COOLER
18
16
14
12
10
36
38
40
KETONE
FRACTIONATOR
70
72
FUEL OIL & RESIN
68
KETONE
PHASE SEPARATOR
42
48
46
44
50
BRINE
WATER
58
56
60
SEPARATOR
62
WATER
66
ASPHALT
64
54
52
FLASH COLUMN

PROCESS FOR RECOVERING FUEL OIL FROM TOPPED CRUDE

BACKGROUND OF THE INVENTION

The present invention relates to a process for recovering gas oil or fuel oil from topped crude oil. More particularly the present invention relates to a process for recovering a substantially asphalt-free fuel oil from a topped crude oil, the asphalt-free fuel oil being usable as a feed to a commercial hydrodesulfurization unit.

In the refining of crude oil, it is common practice to atmospherically distill the crude oil to recover various fractions of gases, gasoline, kerosene, gas or fuel oil, etc. The heavy, residual material remaining from the atmospheric distillation, commonly referred to as topped crude oil, can vary in amount but may comprise up to about 40% by volume of the original crude oil and contains the asphalt originally present in the crude oil. The heavy, residual material can be further treated by vacuum distillation to recover additional quantities of gas oil and provide a residuum, commonly referred to as vacuum reduced crude oil. Vacuum reduced crude oil generally amounts to about 5 to about 25% by volume of the original crude oil. For purposes herein, the term "topped crude oil" shall include the materials defined above as "residual material" and "residuum." It is common practice to treat the topped crude oil, as for example by extraction techniques, to produce an asphalt suitable for uses such as an asphalt cement for road construction, and recover further fuel oil. Such a process is described in U.S. Pat. No. 3,658,695.

To render the recovered fuel oil suitable for end uses, it is often desireable that it be desulfurized by treatment in a hydrodesulfurization unit or the like. Depending on its origin, crude oil contains in the range of from about 20 to about 9,000 ppmw (parts per million by weight) metal contaminants such as compounds (many of unknown type) of nickel and vanadium. In the refining processes described above, the metal contaminants tend to concentrate in the topped crude oil and appear in sufficient concentration in the fuel oil recovered therefrom to poison or at least greatly reduce the life of the catalyst used in the commonly employed hydrodesulfurization processes.

SUMMARY OF THE INVENTION

It is therefore an object of the present invention to provide a process for the treatment of topped crude oil to produce a fuel oil which is essentially asphalt-free and relatively low in metal contaminants.

Another object of the present invention is to provide a process for increasing the recovery of fuel oil from topped crude oil.

A further object of the present invention is to provide a process for recovering a fuel oil from a topped crude oil, the fuel oil being suitable as a feed to a hydrodesulfurization unit.

The above and other objects of the present invention will become apparent from the drawings, the description given herein and the appended claims.

In the process of the present invention, the topped crude oil is admixed with a hydrocarbon solvent, the mixture of hydrocarbon solvent and topped crude oil being centrifuged in the presence of a brine carrier. The centrifugation provides a stream of hydrocarbon solvent and fuel oil and a stream comprised of brine, asphalt and fuel oil, the latter stream being generally in the form of an emulsion. The emulsion is admixed with a suitable ketone and the mixture permitted to separate. A ketone rich phase containing substantially all of the fuel oil removed with the brine and asphalt from the centrifugation step is recovered and treated to recover the fuel oil, the ketone being recycled for further use in the process. It is a novel aspect of the process that centrifugation, preferably continuously, in conjuction with the use of a ketone solvent to break the emulsified stream from the centrifuge increases the recovery of fuel oil from the topped crude oil and provides a feedstock suitable for a desulfurization process.

BRIEF DESCRIPTION OF THE DRAWINGS

The single FIGURE is a schematic flow sheet depicting the process of the present invention.

DESCRIPTION OF THE PREFERRED EMBODIMENTS

As used herein, the terms "fuel oil", "gas oil", and "deasphalted oil" will be used synonymously and will refer to the substantially asphalt free material separated from the topped crude oil.

Referring then to the FIGURE, a topped crude oil is fed, via inlet line 10, to mixing vessel 12. A hydrocarbon solvent is also introduced into vessel 12 via line 14, the hydrocarbon solvent and topped crude oil being admixed in vessel 12 by means of stirrer or agitator 16. The hydrocarbon solvent-topped oil mixture leaves vessel 12 via line 18 and passes into cooler 20. The chilled mixture exits cooler 20 via line 22 and is admixed with brine from line 24, the mixture of brine, hydrocarbon and topped crude oil being introduced into centrifuge 26. A separate stream of brine is also introduced into centrifuge 26 through line 28.

In centrifuge 26, the fuel oil which is quite soluble in the hydrocarbon solvent, is separated from the asphalt present in the topped crude oil and is removed, in admixture with the hydrocarbon solvent, via line 30. The hydrocarbon solvent-fuel oil mixture in line 30 is introduced into fractionator 32 wherein the hydrocarbon solvent is taken overhead and recycled to mixer 12 via line 14. The fuel oil, substantially free of asphalt, is removed from fractionator 32 via line 34 and is sent for further processing, as for example to desulfurization.

In centrifuge 26 there is also produced a largely emulsified mixture of brine, precipitated asphalt and heavy fuel oil including resinous materials. This emulsified mixture is removed from centrifuge 26 via line 26 and is combined with a ketone solvent introduced via line 38. The mixture of ketone solent and the emulsion from centrifuge 26 are forced through mixing valve 40 into phase separator 42, valve 40 effecting intimate admixing of the materials.

In phase separator 42, three phases form — a brine rich phase 44 (including a small amount of ketone solvent), an asphalt rich phase 46, and a ketone rich phase 48 containing heavy fuel oil, resins and carried over hydrocarbon solvent. The brine rich phase 44 is removed from phase separator 42 via line 50 and sent to flash column 52, the ketone solvent being removed overhead via line 54 for recycle to line 38, the ketone free brine being removed from column 52 via line 28 for recycle to centrifuge 26. Asphalt phase 46 is removed from phase separator 42 via line 56, is admixed with water from line 58 to effect further emulsion breaking and removal of residual brine, the aqueous asphalt mixture passing through mixing valve 60 into separator 62.

In separator 62, the asphalt and water are separated, the asphalt being recovered via line 64, the water being removed via line 66.

Ketone phase 48 is removed from phase separator 42 via line 68 and introduced into fractionator 70. Ketone phase 48 contains most, if not substantially all, of the residual fuel oil present in the asphalt-brine-fuel oil stream removed from centrifuge 26 via line 36. In fractionator 70, the ketone solvent is separated from the fuel oil and any resinous material and recovered via line 38. The fuel oil and resins are recovered from fractionator 70 via line 72, combined with the fuel oil in line 34 and sent to the desulfurization unit. Hydrocarbon solvent carried from centrifuge 26 is recovered from fractionator 70 via line 74 and recycled to line 14 for mixing with topped crude oil in line 10.

In conducting the process of the present invention, the hydrocarbon solvent which is mixed with the topped crude oil can be chosen from a wide variety of normally liquid hydrocarbons. Generally speaking, the hydrocarbon solvent can comprise an aliphatic, preferably paraffinic, or alicyclic hydrocarbon having from 7 to 15 carbon atoms. Suitable non-limiting examples include heptane, isooctane, kerosene boiling range hydrocarbons, etc. Suitable hydrocarbon solvents which are generally mixtures of the above named compounds, but which may contain minor, non-deleterious, amounts of olefinic and aromatic materials, include various asphalt free fractions derived from the refining of petroluem. Such mixtures are predominately paraffinic in nature. Thus, for example, a heavy Udex raffinate having a paraffinic content of around 85% by volume makes a suitable hydrocarbon solvent for use in the process.

The topped crude oil and hydrocarbon solvent are combined so as to achieve a volume ratio of hydrocarbon solvent to topped crude oil of at least 2:1. Preferably, the volume ratio of hydrocarbon solvent to topped crude oil will range from about 2:1 to about 20:1, and especially from about 4:1 to about 12:1.

In the process of the present invention, the mixture of hydrocarbon solvent and topped crude oil is centrifuged to effect separation of the precipiated, solid asphalt from the fuel oil in the topped crude oil. Preferably, the centrifuging is conducted continuously, the use of batch centrifuging, while feasible, being economically impractical. To facilitate precipitation of the asphlat, it is preferable that the centrifuging be conducted at a relatively low temperature, as for example, from about 30° to about 80° F.

The brine which is used in the centrifuging step acts as a carrier for the precipitated, solid asphalt. The brine can be an aqueous solution of virtually any inorganic salt which is non-reactive under the conditions that are used in the process. Thus, for example, aqueous solutions of sodium chloride, calcium chloride, potassium chloride, mixed salts of sodium and potassium chloride, etc. can be used. It is preferable that some brine be pre-mixed with the hydrocarbon solvent-topped crude oil mixture prior to the introduction of the latter into the centrifuge. Additionally, brine is fed directly to the centrifuge. Generally speaking, the concentration of the water soluble salt in the brine will be such as to provide a brine having a specific gravity higher than the asphalt present in the topped crude oil. This aids in keeping the asphalt suspended in the brine carrier and reduces build up of asphalt in the bowl of the centrifuge. The relative amount of brine and hydrocarbon solvent-topped crude oil mixture fed to the centrifuge will depend upon the composition of the topped crude oil, the ratio of hydrocarbon solvent to topped crude oil, and other such parameters. However, in general, the amount of brine fed in the centrifuging step, on a volume basis, will be greater than the combined hydrocarbon solvent-topped crude oil mixture, an excess brine rate facilitating asphalt removal from the bowl of the centrifuge.

As previously indicated, in the centrifuging step, there is recovered a stream comprised of hydrocarbon solvent and fuel oil, the latter being substantially free of any residual asphalt. The other stream recovered from the centrifuging step comprises an emulsified mixture of from about 70 to about 85% by wt. brine, from about 1.5 to about 5% by wt. asphalt, and from about 1.5 to about 5% by wt. fuel oil and resinous materials and from about 10 to about 20% by wt. carried over hydrocarbon solvent. Thus, while the centrifuging technique, particularly if conducted continuously, provides an efficient method for precipitating the asphalts and recovering fuel oil from the topped crude oil, recovery of the separated asphalt and any remaining fuel oil is difficult because of the emulsification problem. The addition of the ketone solvent to the brine-asphalt-fuel oil mixture results in substantial breaking of the emulsified mixture and permits its separation into three relatively distinct phases — a ketone rich phase containing most of the fuel oil left in the emulsified mixture, an asphalt rich phase, and a brine rich phase, the latter containing a small amount of ketone solvent.

The ketone solvent employed can be any normally liquid aliphatic or alicyclic ketone having about four to 10 carbon atoms. Non-limiting examples of suitble ketones include methyl ethyl ketone, methyl n-propyl ketone, methyl isopropyl ketone, diethyl ketone, 2-hexanone, 3-hexanone, methyl isobutyl ketone, methyl sec-butyl ketone, methyl ter-butyl ketone, ethyl isopropyl ketone, cyclohexanone, etc. Especially preferred is methyl ethyl ketone. The amount of ketone solvent admixed with the emulsified mixture will generally be such so as to provide a volume ratio of ketone solvent to emulsified mixture of greater than 0.5:1, preferably from about 0.5:1 to about 5:1. When the preferred methyl ethyl ketone solvent is employed, a volume ratio of ketone solvent to emulsified mixture of about 1:1 has proven to work quite satisfactorily.

Separation of the ketone solvent-emulsified mixture into the three phases mentioned above can be accomplished by holding the combined materials in a relatively quiescent state, in a settling vessel for a time which depends upon several factors such as the amount of ketone solvent employed, the asphalt content of the emulsified mixture, the volume of the settling vessel, etc. As noted with reference to the description of the drawing, the brine rich and asphalt rich phases can be suitably treated to recover the brine for recycle and recovery of the asphalt for further processing. The ketone rich phase which is recovered from the settling vessel contains substantially all of the fuel oil and other liquid hydrocarbons present in the emulsified mixture removed from the centrifuge as well as some resinous material and hydrocarbon solvent. Since the ketone solvent is easily separable from the liquid hydrocarbons, heavy fuel oil and resins by techniques such as fractionation, the process provides an efficient method for increasing the yield of fuel oil from the topped crude oil. Additionally, as will be seen from the example, the fuel oil recovered from the ketone rich phase has a lower metal contaminants content than the fuel oil recovered from the centrifuge. The net result is a significant increase in the amount of fuel oil recovered from the topped crude oil coupled with the fact that by combining the deasphalted oil from the centrifuge with the heavy fuel oil and resin separated from the ketone rich phase, there is provided a desirable feedstock for a desulfurization unit.

To more fully illustrate the invention, the following non-limiting example is presented.

EXAMPLE

A Sharples Model DHL Nozljector centrifuge was used in the deasphalting process. The data on the centrifuging is for continuous operation. In all cases, the hydrocarbon solvent employed was a heavy Udex raffinate, the properties of which are shown in Table I below. Methyl ethyl ketone (MEK) was used as the ketone solvent in a volume ratio of ketone solvent to emulsified mixture of 1:1.

In Table I below there are shown physical and chemical properties of various topped crude oils and the hydrocarbon solvent used in the centrifuging step of the process of the present invention.

TABLE I

| Description | Lago Medio Vacuum Residuum (1000° F+) | Lago Medio Atmospheric Residual Material (650° F+) | Heavy Udex Raffinate (Hydrocarbon Solvent) |
|---|---|---|---|
| Gravity, °API at 60° F | 8.3–9.9 | 21.2 | 63.0 |
| Specific Gravity, 60/60° F | 1.008 – 1.0125 | 0.9267 | 0.7275 |
| Viscosity at 100° F,cs | — | 162.3 | — |
| at 170° F,cs | 9266.9 | — | — |
| at 210° F,cs | 1678.3 | 15.01 | — |
| Sulfur Content, Wt % | 2.91 | 1.85 | — |
| Trace Metals, PPMW | | | |
| Ni | 83 | 24 | — |
| V | 904 | 254 | — |
| Fe | 3 | 1 | — |
| n-$C_5$Insolubles, Wt % | 12.6 | 4.7 | — |
| ASTM Distillation, ° F | | | |
| IBP/5/10 | — | — | 256/266/267 |
| 20/30/40 | — | — | 269/272/275 |
| 50 | — | — | 278 |
| 60/70/80 | — | — | 282/287/294 |
| 90/95/EP | — | — | 308/328/355 |
| FIA/MS, Vol % | | | |
| Aromatics | — | — | 2.0 |
| Olefins | — | — | 2.4 |
| Paraffins | — | — | 84.7 |
| Cycloparaffins | — | — | 10.9 |

In Tables II and III below are shown the results of deasphalting the topped crude oils shown in Table I using the continuous centrifuging technique described above.

TABLE II

| (LAGO MEDIO VACUUM RESIDUUM) | | |
|---|---|---|
| Run Number | 3 | 4 |
| Centrifuging Run Conditions | | |
| Temperature, ° F | 55 | 51 |
| Hydrocarbon Solvent Dosage,Vol % | 1000 | 500 |
| Charge Rate, Gal./hr. | 10 | 10 |
| Brine Density, Gm./cc. | 1.15 | 1.22 |
| Yields, Wt % (Basis Residuum Charge) | | |
| Asphalt | 18.9 | 8.8 |
| Deasphalted Oil | 81.1 | 91.2 |
| | 100.0 | 100.0 |
| Deasphalted Oil Test Results | | |
| Gravity, ° API at 60° F | 9.5 | 8.0 |
| Sulfur Content, Wt % | 2.69/2.70 | 2.60 |
| n-$C_5$ Insolubles | 8.0 | 8.1 |
| Trace Metals, PPMW | | |
| Ni | 50 | 56 |
| V | 574 | 615 |

TABLE II-continued

| (LAGO MEDIO VACUUM RESIDUUM) | | |
|---|---|---|
| Run Number | 3 | 4 |
| Fe | 57 | 70 |

TABLE III

| (LAGO MEDIO ATMOSPHERIC RESIDUAL MATERIAL) | | |
|---|---|---|
| Run Number | 1 | 2 |
| Centrifuging Run Conditions | | |
| Temperature, ° F | 55 | 46 |
| Hydrocarbon Solvent Dosage, Vo. % | 1000 | 500 |
| Charge Rate, Gal./hr. | 10 | 10 |
| Brine Density, Gm./cc | 1.15 | 1.22 |
| Yields, Wt % (Basis Residual Material Charge) | | |
| Asphalt | 4.9 | 2.4 |
| Deasphalted Oil | 95.1 | 97.6 |
| | 100.0 | 100.0 |
| Deasphalted Oil Test Results | | |
| Gravity, ° API at 60° F | 21.9 | 21.5 |
| Sulfur Content, Wt % | 1.41/1.37 | 1.54 |
| n-$C_5$ Insolubles, Wt % | 3.4 | 4.09 |
| Trace Metals, PPMW | | |
| Ni | 13 | 17 |
| V | 137 | 173 |
| Fe | 62 | 14 |

In Table IV below are shown the results of treating the emulsified mixture from the centrifuge with the methyl ethyl ketone solvent. For comparison purposes, there is also shown corresponding data for the deasphalted oil removed from the centrifuge with the hydrocarbon solvent and the original charged material, i.e. the topped crude oil.

TABLE IV

| Description | Lago Medio Vacuum Residuum (1000° F+) | Deasphalted Oil From Centrifuge | Deasphalted Oil From MEK Treatment | Asphalt From MEK Treatment |
|---|---|---|---|---|
| Yield, Wt % | 100 | 82 | 9.3 | 8.7 |
| Sulfur Content, Wt % | 2.91 | 2.7 | 2.6 | 3.5' |
| n-$C_5$ Insolubles, Wt % | 12.6 | 8.0 | 5.3 | 64.6 |
| Metals, PPMW | | | | |
| Ni | 83 | 56 | 14 | 400' |

TABLE IV-continued

| Description | Lago Medio Vacuum Residuum (1000° F+) | Deasphalted Oil From Centrifuge | Deasphalted Oil From MEK Treatment | Asphalt From MEK Treatment |
|---|---|---|---|---|
| V | 904 | 615 | 227 | 4500' |

'Estimated

As can be seen from comparing columns 2 and 3 of Table IV, the use of ketone solvent treatment results in a recovery of approximately 50% of the asphaltic material present in the emulsified mixture from the centrifuge as a deasphalted oil (See column 3). It is further to be observed that the deasphalted oil from the ketone solvent treatment is of better quality than the deasphalted oil from the centrifuge in that it has a lower n-pentane insolubles and a lower metals content (Compare columns 2 and 3). In effect, the ketone solvent deemulsification treatment effects a deasphalting of the asphaltic material removed from the centrifuge. The net result, of course, is to increase the recoverable fuel oil which can be fed to a hydrodesulferization unit.

While the invention has been described with considerable particularity, it is to be understood that many changes and modifications can be made in the process without departing from the spirit and scope of the invention. Accordingly, it is intended that the scope of the invention be limited only by the claims which follow.

We claim:

1. A process for recovering fuel oil from a topped crude oil comprising:

a. admixing said topped crude oil with a hydrocarbon solvent;

b. centrifuging said mixture of said topped crude oil and said hydrocarbon solvent in the presence of a brine carrier;

c. recovering a brine-asphalt-fuel oil mixture from said centrifuging step;

d. admixing said brine-asphalt-fuel oil mixture with a normally liquid ketone solvent selected from the class consisting of aliphatic and alicyclic ketones having at least four carbon atoms;

e. recovering a ketone rich phase from the mixture produced in step (d); and f. recovering said fuel oil from said ketone rich phase.

2. The process of claim 1 wherein said hydrocarbon solvent is selected from the class consisting of aliphatic and alicyclic hydrocarbons having from seven to 15 carbon atoms.

3. The process of claim 1 wherein said hydrocarbon solvent comprises an aliphatic hydrocarbon having from seven to 15 carbon atoms.

4. The process of claim 3 wherein said hydrocarbon is primarily paraffinic in nature.

5. The process of claim 1 wherein the volume ratio of said hydrocarbon solvent to said topped crude oil is at least 2:1.

6. The process of claim 5 wherein said volume ratio of said hydrocarbon solvent to said topped crude oil is from about 2:1 to about 20:1.

7. The process of claim 1 wherein said centrifuging is conducted at a temperature of from about 30° to about 80° F.

8. The process of claim 1 wherein said brine-asphalt-fuel oil mixture is admixed with said ketone solvent in a volume ratio of ketone solvent to brine-asphalt-fuel oil mixture of greater than 0.5:1.

9. The process of claim 8 wherein said ratio of said ketone solvent to said brine-asphalt-fuel oil mixture is from about 0.5:1 to about 5:1.

10. The process of claim 1 wherein said ketone solvent comprises an aliphatic ketone having from four to 10 carbon atoms.

11. The process of claim 10 wherein said ketone solvent comprises methyl ethyl ketone.

12. The process of claim 11 wherein the volume ratio of said methyl ethyl ketone to said brine-asphalt-fuel oil mixture is about 1:1.

13. The process of claim 1 including recovering a fuel oil-hydrocarbon solvent mixture from said centrifuging step.

14. The process of claim 13 including treating said fuel oil-hydrocarbon solvent mixture to separate said hydrocarbon solvent from said fuel oil and recycling said hydrocarbon solvent for use in said centrifuging step.

15. The process of claim 14 including combining the fuel oil recovered in step (f) with the fuel oil separated from said fuel oil-hydrocarbon solvent mixture to provide a feed for a desulfurization process.

16. The process of claim 1 including recovering an asphalt rich phase from the mixture produced in step (d), admixing said asphalt rich phase with water to produce an aqueous asphalt mixture and recovering asphalt from said aqueous asphalt mixture.

17. The process of claim 1 including recovering a brine rich phase from the mixture produced in step (d) and recovering said brine from said brine rich phase for use in said centrifuging step.

18. The process of claim 17 including separating ketone solvent from said brine rich phase for admixture with said brine-asphalt-fuel oil mixture.

* * * * *